US007808363B1

(12) United States Patent
Cantalice

(10) Patent No.: US 7,808,363 B1
(45) Date of Patent: Oct. 5, 2010

(54) OVERHEAT PROTECTION FOR PUMP

(76) Inventor: John J. Cantalice, 6831 Tierra Verde St., Port Richey, FL (US) 34668

( * ) Notice: Subject to any disclaimer, the term of this patent is extended or adjusted under 35 U.S.C. 154(b) by 77 days.

(21) Appl. No.: 12/321,507

(22) Filed: Jan. 22, 2009

Related U.S. Application Data

(60) Provisional application No. 61/011,808, filed on Jan. 22, 2008.

(51) Int. Cl.
*H01H 37/04* (2006.01)

(52) U.S. Cl. ..... 337/380; 337/298; 337/327; 337/398; 337/414; 361/673; 417/32

(58) Field of Classification Search ..... 337/298, 337/327, 380, 398, 414, 417; 417/32; 361/673
See application file for complete search history.

(56) References Cited

U.S. PATENT DOCUMENTS 2,273,381 A * 2/1942 Shaw ..... 337/359
2,741,988 A 4/1956 Merritt
2,778,313 A 1/1957 Hill
2,907,851 A * 10/1959 Moorhead et al. ..... 337/377
2,940,395 A 6/1960 Hill
2,946,203 A 7/1960 Carver
3,243,679 A 3/1966 Enemark
3,414,225 A * 12/1968 Lester ..... 248/506
4,297,668 A * 10/1981 Place ..... 337/365
4,370,099 A 1/1983 Gannaway
4,446,450 A * 5/1984 Boulanger et al. ..... 337/380
4,620,425 A 11/1986 O'Grady
4,626,821 A * 12/1986 Versaw ..... 337/380
5,307,543 A * 5/1994 Krillenberger ..... 24/543
5,699,033 A * 12/1997 Hofsass ..... 337/380
5,828,287 A 10/1998 Nilson (Continued)

FOREIGN PATENT DOCUMENTS

GB 2258499 A * 2/1993

*Primary Examiner*—Anatoly Vortman
(74) *Attorney, Agent, or Firm*—Frijouf, Rust & Pyle, P.A.

(57) ABSTRACT

An overheating protection device id disclosed for electrically coupling an electrical power source to a fluid propulsion device. The fluid propulsion device includes a propelling member within a manifold for pressurizing a fluid. The propelling member is keyed with a motor. The overheating protection device comprises a housing including a back plate, a top plate, a bottom plate, a first side plate and a second side plate for defining a cavity. The back plate, the top plate, the bottom plate, the first side plate and the second side plate define an aperture. A thermostat switch is positioned within the cavity and is electrically coupled between the electrical power source and the motor. A cover engages the aperture for sealing the thermostat switch within the housing. The cover includes a bore for relieving the thermostat switch. A thermo-conductive layer has an interior surface and an exterior surface. The thermo-conductive layer engages within the bore and the interior surface of the thermo-conductive layer contacts with the thermostat switch for conveying thermo energy between the thermo-conductive layer and the thermostat switch. The exterior surface of the thermo-conductive layer engages the manifold for conveying the thermo energy between the manifold and the thermo-conductive layer. The thermostat switch terminates the electrical power to the motor upon the thermostat switch sensing thermo energy below or above a predetermined temperature range to prevent damage to the fluid propulsion device.

11 Claims, 7 Drawing Sheets

U.S. PATENT DOCUMENTS 5,864,279 A * 1/1999 Becher et al. ..... 337/380
5,870,014 A * 2/1999 Nield et al. ..... 337/362
6,302,361 B1 * 10/2001 Schaefer et al. ..... 248/27.3
6,312,226 B1 11/2001 Senior, Jr. et al.
6,417,758 B1 * 7/2002 Russell et al. ..... 337/380
6,454,538 B1 9/2002 Witham et al.
6,491,500 B1 12/2002 Sun et al.
6,507,267 B2 * 1/2003 Russell et al. ..... 337/380
6,527,517 B1 3/2003 Wallrafen et al.
6,540,484 B1 4/2003 Hugenroth et al.
6,550,962 B1 * 4/2003 Yang et al. ..... 374/147
6,551,065 B2 4/2003 Lee
6,781,504 B2 * 8/2004 Scott et al. ..... 337/380
6,837,688 B2 1/2005 Kimberlin et al.
6,908,289 B2 6/2005 Scanderbeg et al.
2003/0161732 A1 8/2003 Kimberlin et al.
2005/0104710 A1 * 5/2005 Mizuno ..... 337/380
2006/0222507 A1 * 10/2006 Jayanth ..... 417/32
2008/0238603 A1 * 10/2008 Scott et al. ..... 337/380
2009/0090118 A1 * 4/2009 Pham et al. ..... 62/228.5

* cited by examiner

OVERHEAT PROTECTION FOR PUMP

CROSS-REFERENCE TO RELATED APPLICATIONS

This application claims benefit of U.S. Patent Provisional application Ser. No. 61/011,808 filed Jan. 22, 2008. All subject matter set forth in provisional application Ser. No. 61/011,808 is hereby incorporated by reference into the present application as if fully set forth herein.

BACKGROUND OF THE INVENTION

1. Field of the Invention

This invention relates to protection devices and more particularly to an overheating protection device electrically coupling an electrical power source to a fluid propulsion device.

2. Background of the Invention

Fluid delivery systems require a propulsion system in which propels the fluid substance through a conduit. One such propulsion system may include a pump or compressor for creating an increase pressure. If for some reason a blockage in the conduit develops or there is a loss of the fluid substance within the conduit the pump or compressor may be damaged. The damage of the pump or compressor may be sufficient to permanently rendered the pump or compressor useless. Depending upon the utility of the fluid delivery system, substantial and irreparable harm may result to the receiver of the fluid substance. Furthermore, the cost of repairing or replacing the pump or compressor may be substantial and require long periods of time.

Various types of protection devices have been proposed by the prior art for monitoring a fluid delivery system. The following U.S. Patents are examples of attempt of the prior art to solve these problems.

U.S. Pat. No. 2,741,988 to E. J. Merritt discloses a motor driven fluid pump operative to deliver fluid through a discharge conduit and having an electric supply circuit for the motor primarily controlled by a main pressure switch responsive to the pressure in the discharge conduit. A motor protective system comprises a thermostatic switch connected in series circuit relation with the main pressure switch. A thermostatic operating device for the thermostatic switch. The thermostatic operating device is mounted in the discharge conduit and is responsive to the temperature of the fluid in the discharge conduit. A heater is operative when energized to supply heat to the fluid in the discharge conduit. A heater circuit connects the heater to the supply circuit. A second pressure switch is operative to control the operation of the heater circuit. The second pressure switch is responsive to the pressure in the discharge conduit.

U.S. Pat. No. 2,778,313 to R. H. Hill discloses a pump of the positive displacement progressing cavity type having elongated helical stator and rotor members. At least one of the members has a resilient surface portion contacting the other member and in pumping relation to therewith. The surface portion has a tendency to adhere to the other member when overheated and the pump has a tendency to overheat unless operated with an adequate supply of working material in the liquid state for proper lubrication of the rotor and stator members. An electric motor is operatively connected to the pump. Conductors are connected to the motor for supplying electric current to the motor. Magnetic switch means are interposed in the conductors for controlling the supply of current to the motor. A source of electric current energizes the switch means. A thermostat is attached to the pump and connected in circuit with the source of electric current for energizing and deenergizing the switch means in response to changes in pump temperature below or above a predetermined temperature range thereby to prevent overheating and consequent damage to the resilient surface portion.

U.S. Pat. No. 2,940,395 to R. H. Hill discloses in combination a pump unit, an electric motor unit operatively connected to the pump unit. The units are adapted to be disposed adjacent the bottom of a well. Means including a plurality of power conductors adapted to extend downwardly from the ground level to the motor unit for supplying current thereto. Control means are interposed in the power conductors and adapted to be located at the ground level for controlling the supply of electrical current to the motor unit. A control circuit for the control means includes a transformer having a primary winding adapted to be connected to a source of alternative current and a secondary winding connected in the control circuit as a energizing source therefore. A temperature responsive device is attached to the motor. A control conductor connects the control means to the temperature responsive device. A manually operable switch is connected in series in the control circuit and located at ground level. A connection is between the control means and one of the power conductors at the ground level. Means connect the temperature responsive device and the one power conductor adjacent the bottom of the well. The inclusion of the one power conductor in the control circuit thereby eliminates the need for the extending an additional control conductor from the ground level to the temperature responsive device at the bottom of a well.

U.S. Pat. No. 2,946,203 to R. G. Carver discloses a compressor for a refrigerating system. The combination comprises a sealed casing. A compressor unit is disposed within the lower portion of the casing. An electric motor includes a rotor and a stator disposed in the casing above the compressor for driving the compressor unit. Means conduct low-pressure refrigerant gas from the refrigerating system into the compressor unit. Means discharge compressed refrigerant gas from the compressor unit into the casing. A discharge tube conducts compressed refrigerant gas from the casing back into the refrigerating system. The discharge tube has an inlet opening in the upper portions of the casing directly over the rotor so that refrigerant gas is discharged by the compressor unit is forced to flow upwardly over the motor to cool the motor prior to being discharged from the casing. Means supply an electrical current to the motor. Thermal responsive switch means interrupt the electrical current to the motor when the thermal responsive switch means since a predetermined high temperature. A heat conductive metallic well is mounted in the upper portion of the casing and extends downwardly into the casing adjacent to the windings of the stator. The thermal responsive switch means is disposed in the metallic well so that the heat of the refrigerant gas surrounding the well is transferred through the well to the thermal responsive switch means. A heat conductive copper arm is bonded to the base of the metallic well. The copper arm extends inwardly towards the central portion of the casing and has an end portion extending downwardly adjacent the rotor so that heat dissipated by the rotor which is not carried away by the refrigerant gas is transmitted through the copper arm to the thermal responsive switch means to promote rapid response of the thermal responsive switch to heat dissipated by the rotor when the flow of refrigerant gas through the case is reduced or stopped.

U.S. Pat. No. 3,243,679 to A. F. Enemark discloses a motor protective means particularly adapted for a hermetically-sealed motor driven compressor unit for refrigerator and air conditioning units. A motor is contained in the hermetically-sealed capsule and comprises in combination, a starting relay and a motor overload protective device responsive to the temperature of the capsule. A housing has an open side. The starting relay and the overload protective device are mounted in the housing. The open side of the housing is engaged with and is supported on the capsule. The starting relay is fixedly mounted in the housing. Resilient mounting means resiliently mount the overload protection device in the housing. The resilient mounting means have sufficient force to press the temperature responsive protective device directly against the capsule.

U.S. Pat. No. 4,370,099 to E. L. Gannaway discloses a discharge gas temperature sensing corrective arrangement for a hermetic motor-compressor unit wherein a heat sensitive element is supported in a discharge muffler located remote from the compressor outlet and in good heat transfer relation with compressed gas entering the discharge muffler from the compressor outlet so that the heat sensitive element provides an indication of the temperature of that compressed gas as it enters the discharge muffler. The discharge muffler outlet is connected to a somewhat conventional refrigerating circuit and a conduit connects the discharge muffler inlet to the compressor outlet. The compressor may include a plurality of gas compressing cylinders having their respective discharge ports connected together to form a discharge gas manifold which functions as a muffler within the compressor with the conduit connected to that discharge gas manifold. The hermetic unit may include first and second casing portions which are joinable, for example, by welding about an annular region with the sensor coupling circuitry disposed entirely on one side of the plane of the annular region and sufficiently distant from that region to prevent heat damage to the circuitry during the welding operation. The conduit connecting the compressor outlet to the discharge muffler typically passes through the plane of this annular region.

U.S. Pat. No. 4,620,425 to N.J. O'Grady discloses a hermetic compressor including a resilient retainer member adapted to removably secure a thermal overload protector relative to the compressor casing. The overload protector is arranged in a housing which is adapted to engage the upper wall of the casing. The retainer member includes one end portion dimensioned to engage the housing whereby downward pressure on the retainer member secures the overload protector relative to the casing. The overload protector housing is formed to include a pair outwardly projecting leg members. A slot formed on one of the legs aligns with an opening in the other leg are engageable by a tool which is employed to exert an external force on the housing sufficient to allow removal and replacement of the thermal protector housing relative to the retainer member.

U.S. Pat. No. 5,828,287 to B. G. Nilson discloses a new Automatic Thermal Shut-Off Switch for preventing heat damage to a high pressure low volume water pump. The inventive device includes a T-shaped housing having a longitudinal cavity, a bimetallic compression spring within the cavity, a disc within cavity on top of the spring, a pin orthogonally secured to the disc, a first contact, and a second contact electrically in contact. The housing is positioned within an unused port within a pump housing and conducts the heat produced by the pump. The conducted heat expands the spring thereby forcing the pin upwardly to separate the first contact from electrically contact with the second contact.

U.S. Pat. No. 6,312,226 to Senior, Jr. et al. discloses a device and method for detecting bearing overheating in oil-lubricated turbine pumps comprising and temperature transmitting collar and infrared sensor. The temperature transmitting collar is mounted on the pump line shaft immediately adjacent to the stretch bearing, which is the top bearing in the pump system. The infrared sensor is positioned within sensing distance of the temperature transmitting collar and control circuitry is provided to warn of abnormal temperatures and to turn the pump off if temperatures continue to rise to an alarm condition.

U.S. Pat. No. 6,454,538 to Witham et al. discloses a scroll compressor with a motor protector for stopping operation of its motor should conditions be indicative of a problem. The motor protector is sensitive to elevated temperature, and stops operation of the motor should a sensed temperature exceed a predetermined maximum. The motor protector is positioned in a chamber in a rear face of a base of the non-orbiting scroll. A port extends through the base of the non-orbiting scroll to connect a motor protector chamber to a suction chamber. Electric wires connect the motor protector to the motor and extend through this same port. In some embodiments, a pressure relief valve also communicates with the motor protector chamber. In one embodiment the motor protector chamber is enclosed by a cap and the pressure relief valve is mounted in that cap. In another embodiment the pressure relief valve extends through a wall of the non-orbiting scroll. In other embodiments, a pair of mating plugs connect the protector to the motor.

U.S. Pat. No. 6,491,500 to Sun et al. discloses a scroll compressor with a motor protector mounted at a location remote from the motor. The motor protector is of the sort which operates to stop operation of the motor both when the temperatures in the scroll compressor increases, and when the electrical characteristics of the power supplied to the motor depart from those from which are expected. Preferably, the motor protector is mounted in the non-orbiting scroll. Further, the invention includes means to increase the sensitivity of this motor protector to conditions indicative of an outdoor fan failure. In several embodiments, these means include a valve which opens to communicate hot discharge pressure refrigerant over the valve. In one other embodiment, this means is a heat sink operable to take heat away from the motor protector. In this last embodiment, when the volume flow of refrigerant decreases, the amount of heat taken away also decreases.

U.S. Pat. No. 6,527,517 to Walirafen et al. discloses a pump for a coolant circuit of an internal combustion engine of a motor vehicle includes a temperature sensor integrated into the pump for detecting the temperature of the fluid flowing into a pump chamber. The temperature sensor is inserted into a recess of a pump casing of the pump. The recess produces a reduced wall thickness (d) in the region proximate the temperature sensor. The reduced wall thickness improves the heat transition through the pump casing from the fluid to the temperature sensor and reduces the outlay in terms of production. Furthermore, the temperature sensor is arranged on a carrier material common to a control of the pump so that the susceptibility of the contacting of the temperature sensor to faults is reduced.

U.S. Pat. No. 6,540,484 to Hugenroth et al. discloses a thermostat within a scroll compressor such that a thermostat switch is positioned in the non-orbiting scroll, and a body of the thermostat extends through the crankcase. The thermostat communicates with a heater associated with a motor protector circuit. Current is directed to the heater causing the heater to more promptly stop operation of the scroll compressor. A bias element holds the thermostat securely within the crankcase and non-orbiting scroll such that it will not rattle during operation. Several embodiments of the thermostat are disclosed.

U.S. Pat. No. 6,551,065 to A. Lee discloses a device to protect fans from overheating and overloading with driving current. The fan protection device of the present invention monitors the temperature and current change of the operating fan. When the temperature or the current float surpasses a predetermined value, the protection device cuts off the fan's power supply and avoids damage to the unit.

U.S. Pat. No. 6,837,688 to Kimberlin et al. discloses an apparatus for detecting the presence of an overheat condition in a fluid pump includes a pump head for receiving a fluid at a first pressure and outputting the fluid at a second pressure that is greater than the first pressure. A motor is positioned adjacent the pump head to drive the pump head to pressurize the fluid. A single overheat sensor senses an overheat condition in the pump head and an overheat condition in the motor. When a threshold temperature is sensed by the overheat sensor, a switch is activated to prevent operation of the motor. In one embodiment, the overheat sensor and switch are integral and may, for example, take the form of a bi-metal switch formed in the stator windings of the motor. In alternate embodiments, the overheat sensor and switch are separate.

U.S. Pat. No. 6,908,289 to Scanderbeg et al. discloses a pressure sensor subsystem measuring the pressure within a fuel pump and outputs an under-pressure signal when the measured pressure is below a predetermined threshold pressure value. A temperature sensor subsystem measures the temperature within the fuel pump and outputs an over-temperature signal when the measured temperature is above a predetermined threshold temperature value. A timing circuit monitors the pressure sensor subsystem and the temperature sensor subsystem for output of the under-pressure and over-temperature signals and outputs a pump disconnect signal when at least one of the signals is output for a prescribed time duration. A power controller disengages power from the pump upon output of a pump disconnect signal by the timing circuit.

U.S. Patent Application US 2003/0161732 to Kimberlin et al. discloses an apparatus for detecting the presence of an overheat condition in a fluid pump includes a pump head for receiving a fluid at a first pressure and outputting the fluid at a second pressure that is greater than the first pressure. A motor is positioned adjacent the pump head to drive the pump head to pressurize the fluid. A single overheat sensor senses an overheat condition in the pump head and an overheat condition in the motor. When a threshold temperature is sensed by the overheat sensor, a switch is activated to prevent operation of the motor. In one embodiment, the overheat sensor and switch are integral and may, for example, take the form of a bi-metal switch formed in the stator windings of the motor. In alternate embodiments, the overheat sensor and switch are separate.

Although the aforementioned prior art have contributed to the development of the art of support devices, none of these prior art patents have solved the needs of this art.

Therefore, it is an object of the present invention to provide an improved protection device for terminating operation of the pump or compressor before damage results.

Another object of this invention is to provide an improved protection device that is an expensive to manufacture and install.

Another object of this invention is to provide an improved protection device that quickly senses a change in thermal energy of the pump or compressor.

Another object of this invention is to provide an improved protection device that resists activation by other thermal energy sources other than the pump or compressor.

Another object of this invention is to provide an improved protection device that is resistant to corrosion, whether, and ultraviolet radiation.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an overheating protection device electrically couples an electrical power source to a fluid propulsion device. The fluid propulsion device includes a propelling member within a manifold for pressurizing a fluid. The propelling member is keyed with a motor. The overheating protection device comprises a housing including a back plate, a top plate, a bottom plate, a first side plate and a second side plate for defining a cavity. The back plate, the top plate, the bottom plate, the first side plate and the second side plate define an aperture. A thermostat switch is positioned within the cavity and is electrically coupled between the electrical power source and the motor. A cover engages the aperture for sealing the thermostat switch within the housing. The cover includes a bore for relieving the thermostat switch. A thermo-conductive layer has an interior surface and an exterior surface. The thermo-conductive layer engages within the bore and the interior surface of the thermo-conductive layer contacts with the thermostat switch for conveying thermo energy between the thermo-conductive layer and the thermostat switch. The exterior surface of the thermo-conductive layer engages the manifold for conveying the thermo energy between the manifold and the thermo-conductive layer. The thermostat switch terminating the electrical power to the motor upon the thermostat switch sensing thermo energy below or above a predetermined temperature range to prevent damage to the fluid propulsion device.

In a more specific embodiment of the invention, the housing and the cover are constructed of a polymeric material. The thermo-conductive layer is constructed of a metallic material. An insulating layer is positioned between the back plate and the thermostat switch for insulating the housing. The insulating layer provides a tensile force between the back plate and the thermostat switch for creating a compressive force between the thermostat switch and the thermo-conductive layer for maintaining contact between the interior surface of the thermo-conductive layer with the thermostat switch.

In a more specific embodiment of the invention, a first side insulating layer is positioned between the first side plate and the thermostat switch for insulating the housing. A second side insulating layer is positioned between the second side plate and the thermostat switch for insulating the housing. A top insulating layer is positioned between the top plate and the thermostat switch for insulating the housing. A polystryrene cement bonds the cover to the aperture of the housing. A polyepoxide polymer bonds the thermo-conductive layer to the bore of the cover. A polyepoxide polymer bonds the back plate to the manifold of the fluid propulsion device.

In one embodiment of the invention, a protective layer is positioned between the thermostat switch and the interior surface of the thermo-conductive layer for preventing a bonding agent from damaging the thermostat switch. The thermostat switch is electrically coupled between the electrical power source to the motor by a series circuit configuration.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figures 1, 2:
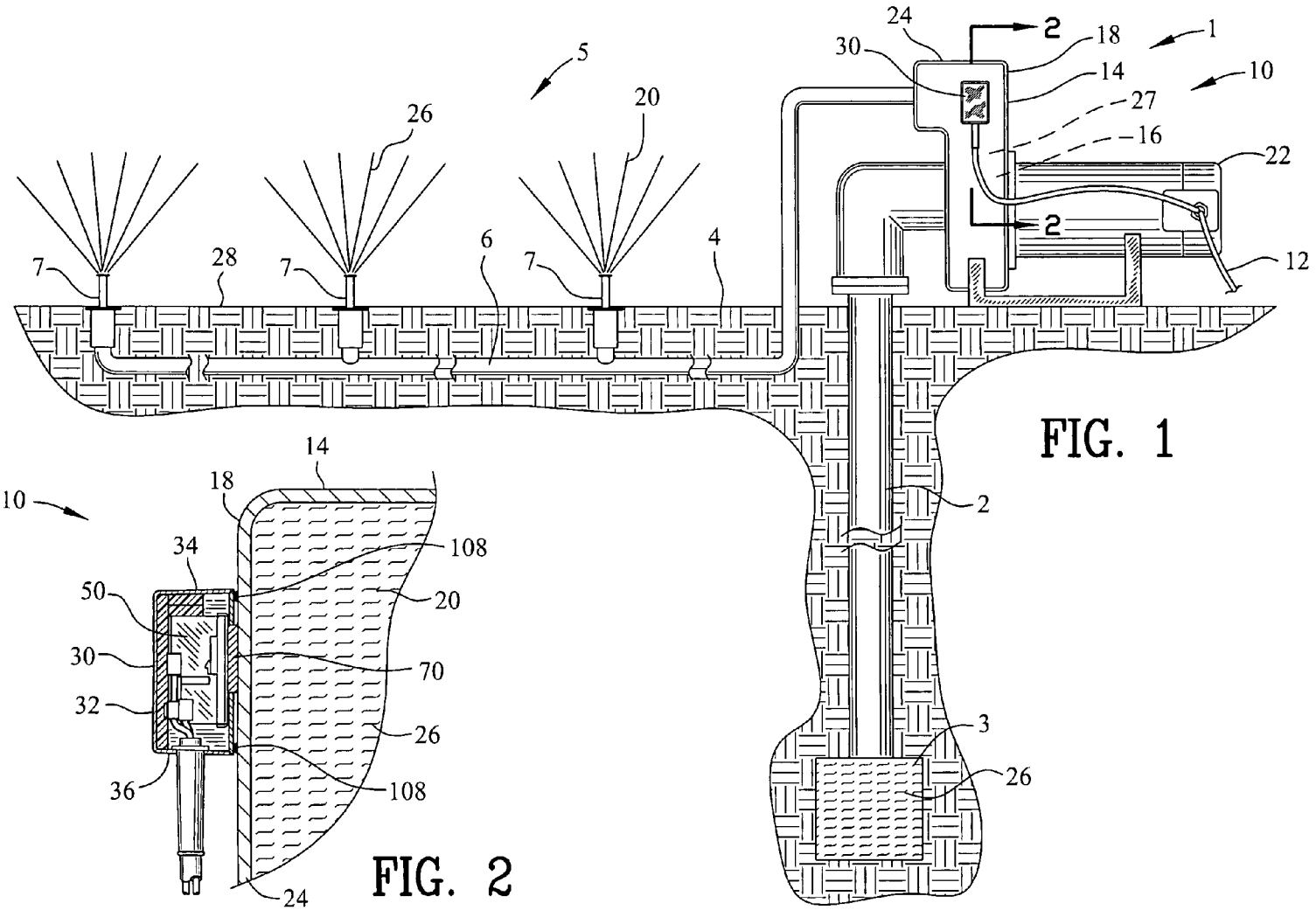
FIG. 1 is a side view of an overheating protection device of the present invention.
FIG. 2 is a sectional view along line 2-2 in FIG. 1.
Figure 3:
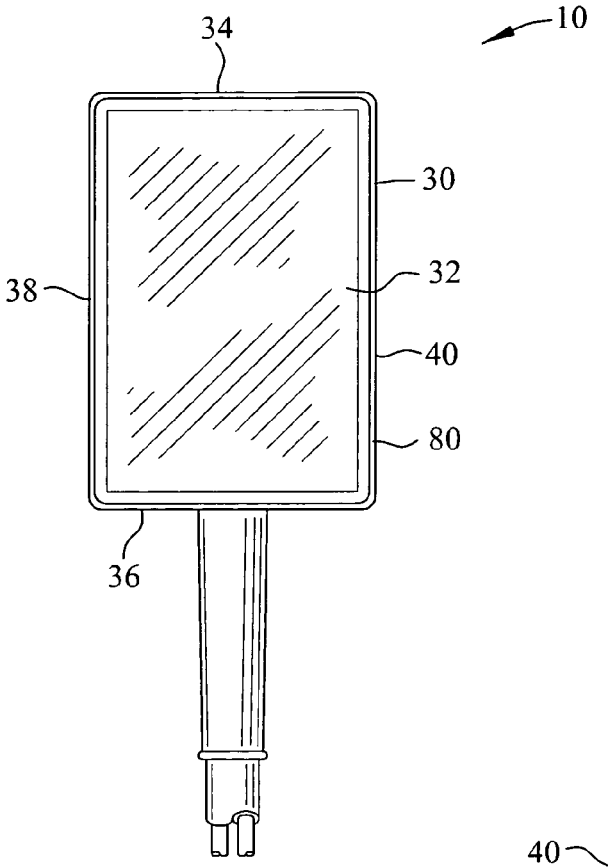
FIG. 3 is a back view of the overheating protection device in FIG. 1.
Figure 4:
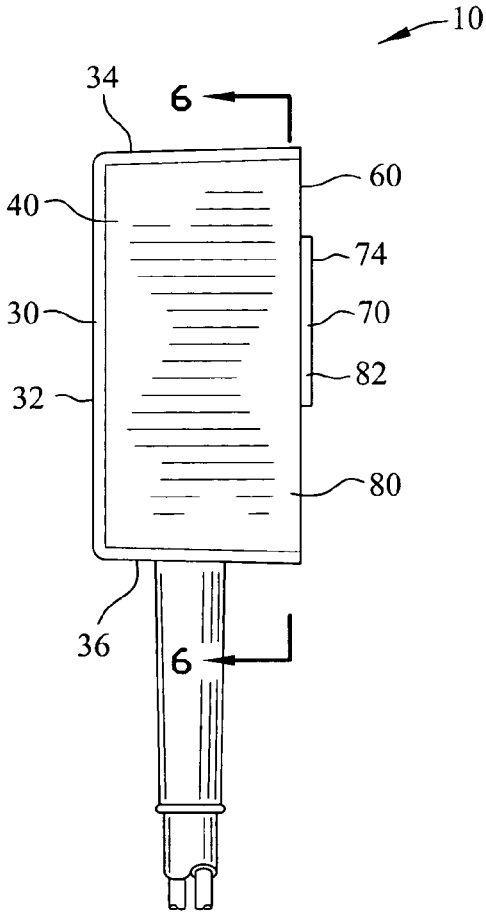
FIG. 4 is a side view of the overheating protection device in FIG. 1.
Figure 5:
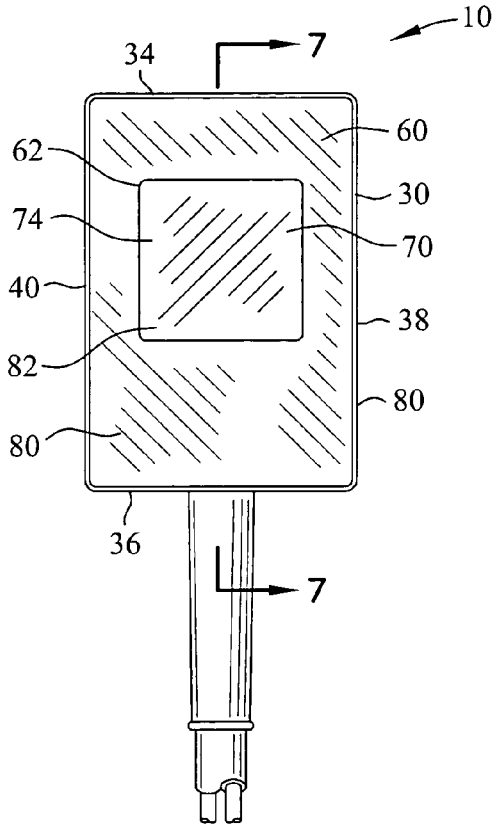
FIG. 5 is a front view of the overheating protection device in FIG. 1.
Figure 6:
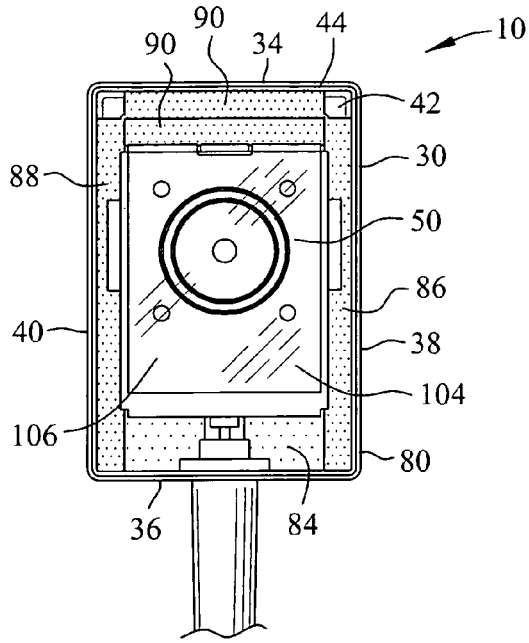
FIG. 6 is a sectional view along line 6-6 in FIG. 4.

FIG. 1 illustrates a water irrigation system 1 having a well 2 that extends between a water source 3 containing water 2 and a ground surface 4. The water irrigation system 1 further includes a water distribution network 5 having a supply conduit 6 and one or more dispensers 7. A fluid propulsion device 14 is linked between the well 2 and the water irrigation system 1 for displacing a fluid 20 and causing the fluid 20 to flow between the well 2 and the dispensers 7. The fluid propulsion device 14 includes a propelling member 16 within a manifold 18 for pressurizing a fluid 20. The propelling member 16 is keyed with a motor 22. In FIG. 1, the fluid propulsion device 14 is shown to include a liquid pump 24 for the dispensing water 26 over the ground 28. The liquid pump 24 includes an impeller 27 rotating within the manifold 18. It should be understood that the overheating protection device 10 may be utilized for many other fluid propulsion devices including but not limited to positive displacement pumps, rotodynamic pumps or other displacement pumps. The pumps may be utilized for aqueous or gaseous applications, wherein pumps or compressors are utilized.

The fluid propulsion device 14 is vulnerable and may be subject to irreparable damage to excessive heat. Excessive heat may be generated within the fluid propulsion device 14 if the fluid 20 terminates displacement and the fluid propulsion device 14 continues to operate. Once the fluid 20 terminates displacement, the fluid 20 within the fluid propulsion device increases in temperature. If the internal temperature within the fluid propulsion device 14 exceeds above or below the design parameters of the fluid propulsion device 14, irrevocable damage may occur to the fluid propulsion device 14. The termination of the displacement of the fluid 20 may occur due to one of the following one of the following occurs: a loss of fluid prime, failure of a pressure switch, failure of a valve, a stuck relay, low water tables and/or user error.

FIGS. 1-14 illustrate an overheating protection device 10 electrically coupling an electrical power source 12 to the fluid propulsion device 14. The overheating protection device 10 terminates the current flow from the political power source 12 to the fluid propulsion device 14 upon the fluid 20 within the fluid propulsion device 14 obtaining a temperature above or below a preset temperature range. The preset temperature range is established such that the overheating protection device 10 terminates the operation of the fluid propulsion device 14 before the internal temperature within the fluid propulsion device 14 causes damage.

The overheating protection device 10 comprises a housing 30 including a back plate 32, a top plate 34, a bottom plate 36, a first side plate 38 and a second side plate 40 for defining a cavity 42. The back plate 32, the top plate 34, the bottom plate 36, the first side plate 38 and the second side plate 40 define an aperture 44. A thermostat switch 50 having a temperature setting knob 52 is positioned within the cavity 42 and is electrically coupled between the electrical power source 12 and the motor 22. Preferably, the thermostat switch 50 is set to open the electric circuit at a temperature of 120 F and to close the electric circuit at a temperature of 110 F. A cover 60 engages the aperture 44 for sealing the thermostat switch 50 within the housing 30. The cover 60 includes a bore 62 for relieving the thermostat switch 50.

A thermo-conductive layer 70 has an interior surface 72 and an exterior surface 74. The thermo-conductive layer 70 engages within the bore 62. The interior surface 72 of the thermo-conductive layer 70 makes contact with the thermostat switch 50 for conveying thermo energy between the thermo-conductive layer 70 and the thermostat switch 50. The exterior surface 74 of the thermo-conductive layer 70 engages the manifold 18 for conveying the thermo energy between the manifold 18 and the thermo-conductive layer 70. The thermostat switch 50 terminates the electrical power to the motor 22 upon the thermostat switch 50 sensing thermo energy below or above a predetermined temperature range to prevent damage to the fluid propulsion device 14. The thermostat switch 50 may further allow the electrical power to the motor 22 upon the thermostat switch 50 sensing thermo energy within a predetermined temperature range to reactivate the fluid propulsion device 14.

The housing 30 and the cover 60 may be constructed of a polymeric material 80. The thermo-conductive layer 70 is constructed of a metallic material 82 or other thermo-transmitting material. The metallic material 82 may include aluminum or other thermoconductive materials.

Figure 7:
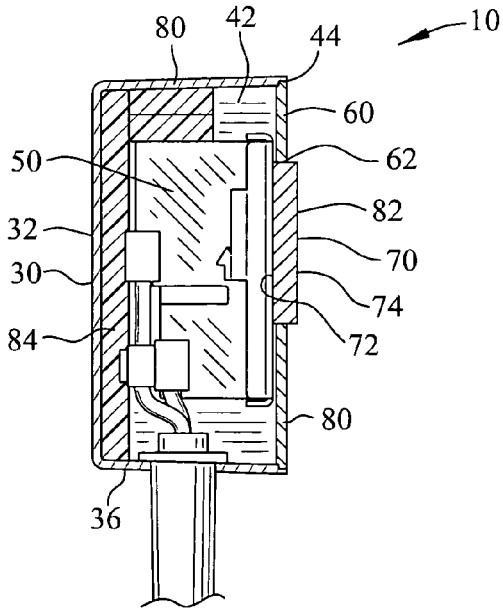
FIG. 7 is a sectional view along line 7-7 in FIG. 5.
Figure 8:
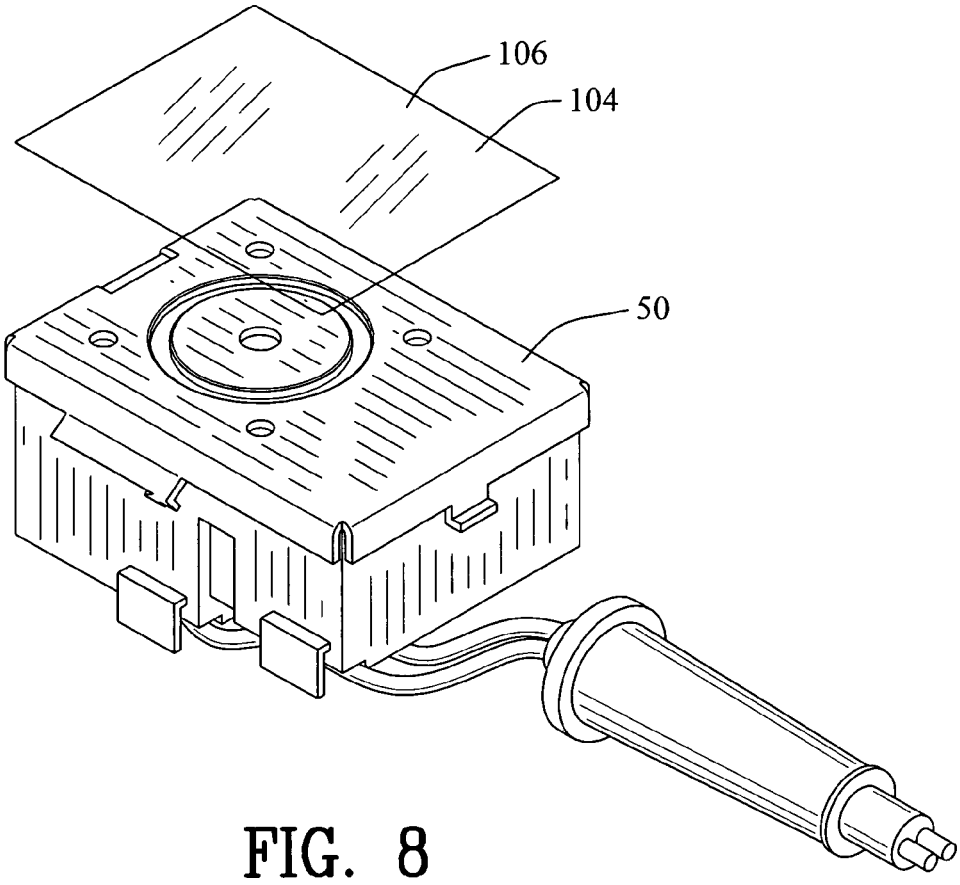
FIG. 8 is an isometric view of a thermostat switch receiving a transparent protective layer.
Figure 9:
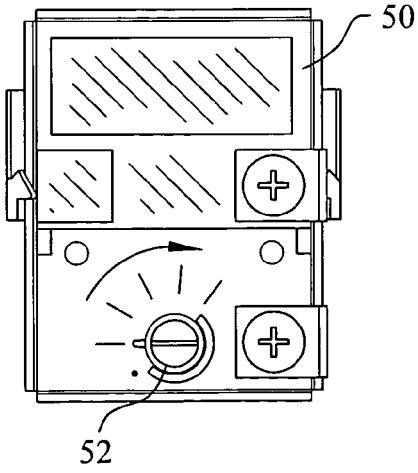
FIG. 9 is a rear view of the thermostat switch in FIG. 8.
Figure 10:
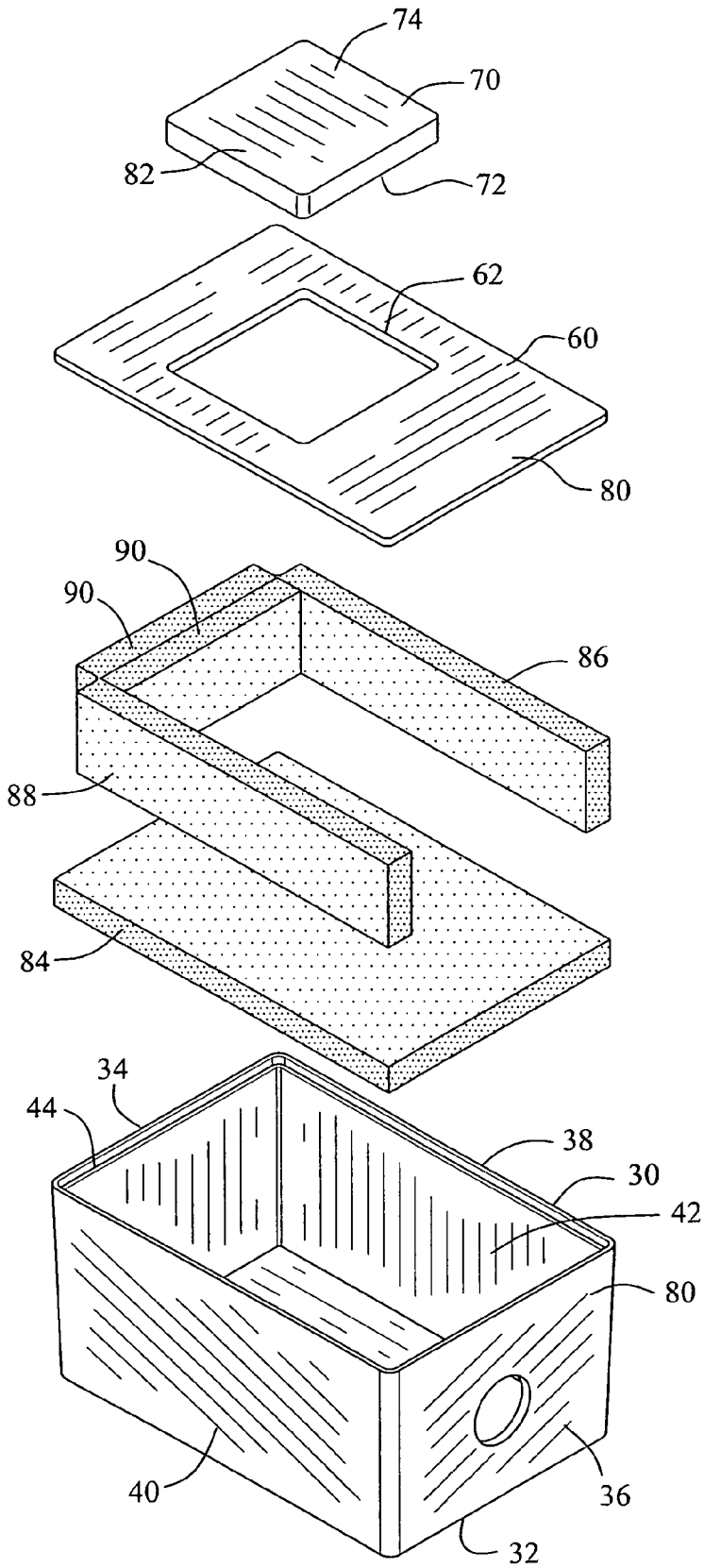
FIG. 10 is an exploded view of the overheating protection device without the thermostat switch.
Figure 11:
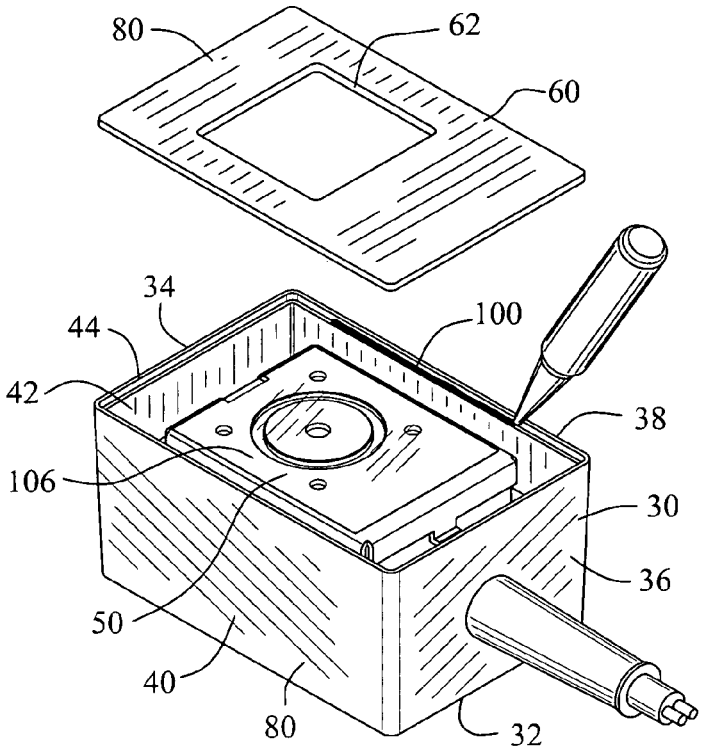
FIG. 11 is an isometric view illustrating a cover positioned to be engaged with a housing.
Figure 12:
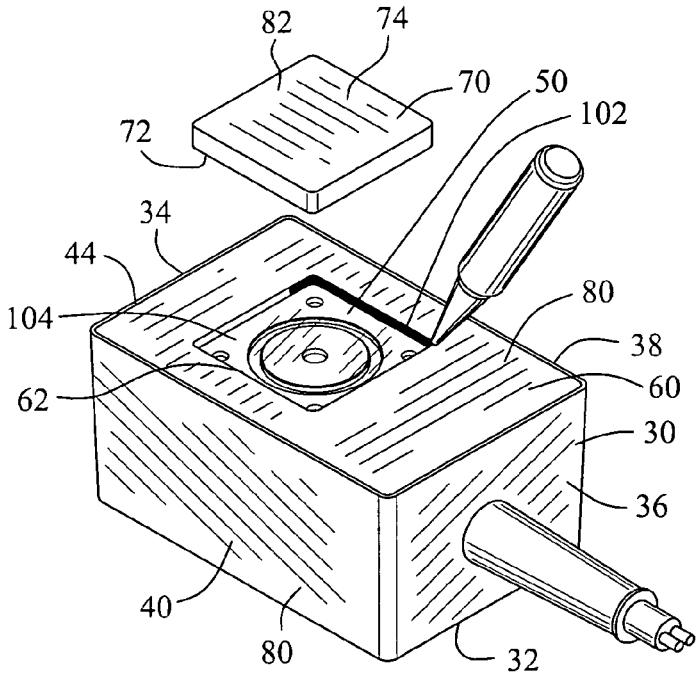
FIG. 12 is an isometric view similar to FIG. 11 illustrating a thermo-conductive layer positioned to be engaged with a bore.
Figure 13:
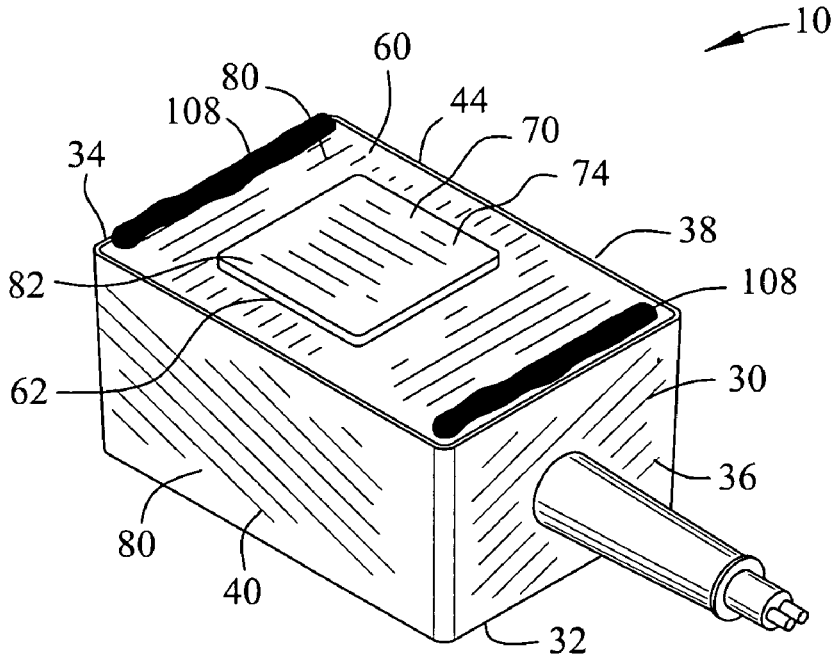
FIG. 13 is an isometric view similar to FIG. 12 illustrating the thermo-conductive layer engaged with the bore and an epoxy applied to housing.
Figure 14:
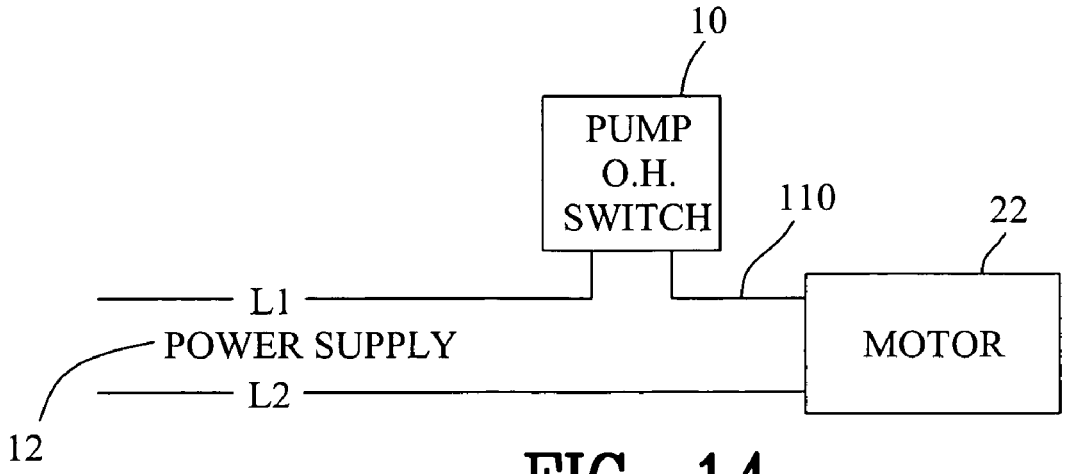
FIG. 14 is an electric circuit illustrating the overheating protection device electrically coupled to a fluid propulsion device.

An insulating layer 84 is positioned between the back plate 32 and the thermostat switch 50 for insulating the housing 30. As best seen in FIGS. 2 and 7, the insulating layer further provides a tensile force between the back plate 32 and the thermostat switch 50 for creating a compressive force between the thermostat switch 50 and the thermo-conductive layer 70 for maintaining contact between the interior surface 72 of the thermo-conductive layer 70 with the thermostat switch 50.

A first side insulating layer 86 is positioned between the first side plate 38 and the thermostat switch 50 for insulating the housing 30. Furthermore, a second side insulating layer 88 is positioned between the second side plate 40 and the thermostat switch 50 for insulating the housing 30. A top insulating layer 90 is positioned between the top plate 34 and the thermostat switch 50 for insulating the housing 30. The insulating layer 84, first side insulating layer 86, the second side insulating layer 88, and the top insulating layer 90 prevent the thermal energy from the outside the housing 30 from traversing into the thermostat switch 50. As such, a high percentage of the thermo energy absorbed by the thermostat switch 50 would be from the manifold 18, through the thermo-conductive layer 70 and to thermostat switch 50.

A polystryrene cement 100 bonds the cover 60 to the aperture 44 of the housing 30. A polyepoxide polymer 102 bonds the thermo-conductive layer 70 to the bore 62 of the cover 60. As such the overheating protection device 10 is water resistant and may be placed either in an indoor or outdoor application without compromising the performance of the overheating protection device 10.

A protective layer 104 is positioned between the thermostat switch 50 and the interior surface 72 of the thermo-conductive layer 70 for preventing a bonding agent from damaging the thermostat switch 50. The protective layer 104 may include a transparent adhesive tape 106. The bonding agent may include the polyepoxide polymer 102 that bonds the thermo-conductive layer 70 to the bore 62 of the cover 60.

In order to construct the overheating protection device 10 the insulating layer 84 is positioned adjacent the back plate 32. The thermostat switch 50 is then installed within the cavity 42 of the housing 30. The protective layer 104 may then be secured to the thermostat switch 50 by an adhesive on the protective layer 104. The polystryrene cement 100 is then applied to the aperture 44 of the housing 30. The cover 60 is then placed within the aperture 44. The polyepoxide polymer 102 is then applied within the bore 62 of the cover 60. The thermoconductive layer 70 is then compressed within the bore 62 for compression against the thermoconductive layer 70. The thermostat switch 50 in turn compresses the insulating layer 84. The compressive force applied upon the thermoconductive layer 70 remains until the polyepoxide polymer 102 has cured. After removing the compressive force applied upon the thermoconductive layer 70, the insulating layer 84 expands to apply a tensile force between the back plate 32 and the thermostat switch 50 for creating a compressive force between the thermostat switch 50 and the thermo-conductive layer 70. The compressive force between the thermostat switch 50 and the thermo-conductive layer 70 maintains contact between the interior surface 72 of the thermo-conductive layer 70 with the thermostat switch 50

A polyepoxide polymer 108 may be utilized for bonding the back plate 32 to the manifold 18 of the fluid propulsion device 14. The polyepoxide polymer 108 is applied to the cover 60. The overheating protection device 10 is then compressed against the manifold 18 of the fluid propulsion device until the thermo-conductive layer 70 makes contact with the manifold 18. The polyepoxide polymer 108 retains the overheating protection device 10 against the manifold 18 until the polypoxide polymer 108 has fully cured.

The thermostat switch 50 may be electrically coupled between the electrical power source 12 to the motor 22 by a series circuit configuration 110, between the electrical power source 12 and a pump start relay, or between the electrical power source 12 and a pressure switch or between the electrical power source 12 and a pump station controller.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An overheating protection device for electrically coupling an electrical power source to a fluid propulsion device, the fluid propulsion device including a propelling member within a manifold for pressurizing a fluid, the propelling member keying with a motor, the overheating protection device, comprising:

a housing including a back plate, a top plate, a bottom plate, a first side plate and a second side plate for defining a cavity;

said back plate, said top plate, said bottom plate, said first side plate and said second side plate defining an aperture;

a thermostat switch positioning within said cavity and electrically coupling between the electrical power source and the motor;

a cover engaging said aperture for sealing said thermostat switch within said housing;

said cover including a bore for relieving said thermostat switch;

a thermo-conductive layer having an interior surface and an exterior surface;

said thermo-conductive layer engaging within said bore and said interior surface of said thermo-conductive layer contacting with said thermostat switch for conveying thermo energy between said thermo-conductive layer and said thermostat switch;

said exterior surface of said thermo-conductive layer engaging the manifold for conveying thermo energy between the manifold and the thermo-conductive layer; and said thermostat switch terminating the electrical power to the motor upon said thermostat switch sensing thermo energy below or above a predetermined temperature range to prevent damage to the fluid propulsion device.

2. An overheating protection device for electrically coupling an electrical power source to a fluid propulsion device as set forth in claim 1, wherein said housing is constructed of a polymeric material.

3. An overheating protection device for electrically coupling an electrical power source to a fluid propulsion device as set forth in claim 1, wherein said cover is constructed of a polymeric material.

4. An overheating protection device for electrically coupling an electrical power source to a fluid propulsion device as set forth in claim 1, wherein said thermo-conductive layer is constructed of a metallic material.

5. An overheating protection device for electrically coupling an electrical power source to a fluid propulsion device as set forth in claim 1, wherein an insulating layer is positioned between said back plate and said thermostat switch for insulating said housing; and said insulating layer providing a tensile force between said back plate and said thermostat switch for creating a compressive force between said thermostat switch and said thermo-conductive layer for maintaining contact between said interior surface of said thermo-conductive layer with said thermostat switch.

6. An overheating protection device for electrically coupling an electrical power source to a fluid propulsion device as set forth in claim 1, wherein a first side insulating layer is positioned between said first side plate and said thermostat switch for insulating said housing;

a second side insulating layer is positioned between said second side plate and said thermostat switch for insulating said housing; and a top insulating layer is positioned between said top plate and said thermostat switch for insulating said housing.

7. An overheating protection device for electrically coupling an electrical power source to a fluid propulsion device as set forth in claim 1, wherein a polystryrene cement bonds said cover to said aperture of said housing; and a polyepoxide polymer bonds said thermo-conductive layer to said bore of said cover.

8. An overheating protection device for electrically coupling an electrical power source to a fluid propulsion device as set forth in claim 1, wherein a protective layer is positioned between said thermostat switch and said interior surface of said thermo-conductive layer for preventing a bonding agent from damaging said thermostat switch.

9. An overheating protection device for electrically coupling an electrical power source to a fluid propulsion device as set forth in claim 1, wherein said thermostat switch is electrically coupled between the electrical power source and the motor by a series circuit configuration.

10. An overheating protection device for electrically coupling an electrical power source to a fluid propulsion device as set forth in claim 1, wherein a polyepoxide polymer bonds the back plate to the manifold of the fluid propulsion device.

11. An overheating protection device for electrically coupling an electrical power source to a fluid pump, the fluid pump including an impeller rotating within a manifold for pressurizing a fluid, the impeller keying with a motor, the overheating protection device, comprising:

a housing including a back plate, a top plate, a bottom plate, a first side plate and a second side plate for defining a cavity;

said back plate, said top plate, said bottom plate, said first side plate and said second side plate defining a aperture;

an insulating layer is positioned adjacent to said back plate for insulating said housing;

a thermostat switch positioning within said cavity and electrically coupling between the electrical power source and the motor;

a cover engaging said aperture for sealing said thermostat switch within said housing;

said cover including a bore for relieving said thermostat switch;

a thermo-conductive layer having a interior surface and an exterior surface;

said thermo-conductive layer engaging within said bore and said interior surface of said thermo-conductive layer contacting with said thermostat switch for conveying a thermo energy between the thermo-conductive layer and said thermostat switch;

said insulating layer providing a tensile force between said back plate and said thermostat switch for creating a compressive force between said thermostat switch and said thermo-conductive layer for maintaining contact between said interior surface of said thermo-conductive layer with said thermostat switch;

said exterior surface of said thermo-conductive layer engaging the manifold for conveying the thermo energy between the manifold and the thermo-conductive layer; and said thermostat switch terminating the electrical power to the motor upon said thermostat switch sensing thermo energy below or above a predetermined temperature range to prevent damage to the fluid pump.

* * * * *